US008562379B2

(12) United States Patent
Miyazaki et al.

(10) Patent No.: US 8,562,379 B2
(45) Date of Patent: Oct. 22, 2013

(54) SOCKET AND CONNECTOR

(75) Inventors: Yoji Miyazaki, Ise (JP); Kenji Ookura, Tsu (JP)

(73) Assignee: Panasonic Corporation, Osaka (JP)

( * ) Notice: Subject to any disclaimer, the term of this patent is extended or adjusted under 35 U.S.C. 154(b) by 61 days.

(21) Appl. No.: 13/023,799

(22) Filed: Feb. 9, 2011

(65) Prior Publication Data

US 2011/0195610 A1 Aug. 11, 2011

(30) Foreign Application Priority Data

Feb. 10, 2010 (JP) ..... 2010-027431

(51) Int. Cl.
*H01R 24/00* (2011.01)

(52) U.S. Cl.
USPC ..... 439/660; 439/74

(58) Field of Classification Search
USPC ..... 439/660, 74, 862
See application file for complete search history.

(56) References Cited

U.S. PATENT DOCUMENTS

| | | | | |
|---|---|---|---|---|
| 5,277,597 | A | 1/1994 | Masami et al. | |
| 7,278,861 | B2 | 10/2007 | Kishi et al. | |
| 7,387,540 | B1 * | 6/2008 | Van der Steen | 439/660 |
| 7,410,364 | B2 * | 8/2008 | Kishi et al. | 439/74 |
| 7,425,158 | B2 * | 9/2008 | Ookura | 439/660 |
| 7,722,408 | B2 * | 5/2010 | Miyazaki et al. | 439/660 |
| 7,736,177 | B2 * | 6/2010 | Tsai | 439/570 |
| 2009/0325396 | A1 | 12/2009 | Takeuchi | |

FOREIGN PATENT DOCUMENTS

| | | |
|---|---|---|
| JP | S62-254378 | 11/1987 |
| JP | H05-084045 | 4/1993 |
| JP | H07-263091 | 10/1995 |
| JP | 2006-351223 | 12/2006 |
| JP | 2007165195 | 6/2007 |

OTHER PUBLICATIONS

The Japanese Office Action dated Nov. 22, 2011 and English summary thereof.
Office Action dated Jan. 22, 2013 issued in corresponding Chinese application No. 2011 10036150.4.
Office Action dated Jun. 21, 2013 issued in corresponding Taiwanese application No. 100104419.

* cited by examiner

*Primary Examiner* — Hien Vu
(74) *Attorney, Agent, or Firm* — Bacon & Thomas, PLLC

(57) ABSTRACT

A socket includes a substantially rectangular columnar socket body made of an insulating material and the socket body including a connection recess portion defined on one surface thereof. Side walls opposed to each other in a transverse direction and lead-out pathways formed in the side walls. The socket further includes a plurality of socket contact members arranged side by side within the connection recess portion along a longitudinal direction. One-end portions of the socket contact members extend through the lead-out pathways and protruding outwards beyond an outer surface of at least one of the side walls of the socket body. The socket body includes a depression portion formed on the side wall through which the socket contact members protrude and the depression portion being formed at least around the socket contact members.

19 Claims, 15 Drawing Sheets

SOCKET AND CONNECTOR

FIELD OF THE INVENTION

The present invention relates to a connector including a socket and a header which are coupled together and electrically connected to each other.

BACKGROUND OF THE INVENTION

As shown in FIG. 9, there is conventionally available a connector including a socket 81 and a header 82 for electrically interconnecting printed wiring boards (not shown) (e.g., flexible printed circuit boards or rigid boards) to which they are respectively mounted (see, e.g., Japanese Patent Application Publication No. 2007-165195). In the following description, up-down and left-right directions will be defined on the basis of FIG. 9 and the direction perpendicular to the up-down and left-right directions in FIG. 9 will be referred to as "front-rear direction".

The socket 81 includes a substantially rectangular columnar socket body 811 made of an insulating material and a plurality of socket contact members 812, made by bending a strip-shaped metal plate, held in the socket body 811.

The socket body 811 has a connection recess portion 811*a* formed on the upper surface thereof. The socket contact members 812 are arranged side by side within the connection recess portion 811*a* along the longitudinal direction (or the front-rear direction) of the socket body 811. Furthermore, the socket body 811 has lead-out pathways 811*b* formed in the left and right side walls to communicate with the connection recess portion 811*a*. One-end portions of the socket contact members 812 extend through the lead-out pathways 811*b* and protrude outwards beyond the outer surfaces of the left and right side walls of the socket body 811, respectively.

The header 82 includes a header body 821 made of an insulating material and a plurality of header contact members 822, made by being a strip-shaped metal plate, held in the header body 821.

If the header 82 is inserted into the connection recess portion 811*a*, the header contact members 822 make conductive contact with the socket contact members 812, allowing the socket 81 and the header 82 to be electrically connected to each other.

The tip end portions of the socket contact members 812 protruding from the outer surfaces of the respective side walls of the socket body 811 are arranged side by side along the front-rear direction and soldered to the corresponding wiring patterns of the printed wiring boards. In this regard, if the positions of the tip end portions of the socket contact members 812 are highly non-uniform in the up-down direction, it is likely that the connection state between the socket 81 and the printed wiring boards becomes unstable.

For that reason, before soldering the socket 81 and the printed wiring boards together, it is necessary to measure the planarity of the tip end portions of the socket contact members 812 and to inspect whether the deviations of the tip end portions fall within a prescribed range. In this connection, as shown in FIGS. 10A to 11, the inspection is a gauge inspection conducted by use of a rail 91 on which the socket 81 is placed and a pair of inspection jigs 92 provided on one surface of the rail 91 in a spaced-apart opposing relationship with each other. The socket 81 is conveyed along the rail 91 by an air blown toward the socket 81.

The inspection jigs 92 are provided to oppose to each other in the direction perpendicular to the conveying direction of the socket 81 (namely, in the direction indicated by an arrow in FIG. 10B). The socket 81 conveyed passes through between the inspection jigs 92. At this time, if the tip end portions of the socket contact members 812 pass through the gaps G between the rail 91 and the inspection jigs 92 without making contact with the inspection jigs 92, it is determined that the socket 81 has a good quality (the deviation of the tip end portions is small). In contrast, if the socket contact members 812 make contact with the inspection jigs 92, it is determined that the socket 81 has a poor quality (the deviation of the tip end portions is great).

In this regard, the left-right dimension, i.e., width dimension, of the socket 81 in FIG. 11 is assumed to be "L". The protrusion length of the socket contact members 812 protruding beyond the socket body 811 is assumed to be "P". The overlapping amount between the socket contact members 812 and the inspection jigs 92 is assumed to be "Q".

In the conventional connector mentioned above, a demand has existed for reduction in size. This requires the width L to be set small. In order to make the width L small, there is a need to reduce the protrusion length P of the socket contact members 812.

If the protrusion length P is set small as shown in FIG. 12, however, it becomes impossible to make the overlapping amount Q great enough (the overlapping amount Q is zero in FIG. 12) although it is possible to reduce the width L. This poses a problem in that the inspection cannot be conducted in an accurate manner. Alternatively, an image inspection may be used as another inspection method. However, the image inspection is less accurate than the gauge inspection set forth above.

SUMMARY OF THE INVENTION

In view of the above, the present invention provides a socket capable of enjoying reduction in size and allowing the planarity of socket contact members to be inspected with increased accuracy.

In accordance with a first embodiment of the invention, there is provided a socket, including: a substantially rectangular columnar socket body made of an insulating material, the socket body including a connection recess portion defined on one surface thereof, side walls opposed to each other in a transverse direction and lead-out pathways formed in the side walls; and a plurality of socket contact members arranged side by side within the connection recess portion along a longitudinal direction, one-end portions of the socket contact members extending through the lead-out pathways and protruding outwards beyond an outer surface of at least one of the side walls of the socket body, wherein the socket body includes a depression portion formed on the side wall through which the socket contact members, protrude, the depression portion being formed at least around the socket contact members.

The depression portion may be formed to continuously extend from one longitudinal end of the socket body to the other longitudinal end. The socket contact members may be protruding through the bottom surface of the depression portion.

The depression portion may be formed around each of the socket contact members in a one-to-one relationship.

The depression portion may include an inner wall surface being inclined to make an obtuse angle with respect to the bottom surface thereof.

In accordance with a second embodiment of the invention, there is provided a connector, including: the socket described above and a header including a header body made of an insulating material and a plurality of, header contact members held in the header body, the header contact members arranged to make conductive contact with the socket contact members when the header is inserted into the connection recess portion of the socket.

As summarized above, the present invention can provide a socket capable of enjoying reduction in size and allowing the planarity of socket contact members to be inspected with increased accuracy.

BRIEF DESCRIPTION OF THE DRAWINGS

The objects and features of the present invention will become apparent from the following description of embodiments, given in conjunction with the accompanying drawings, in which.

DETAILED DESCRIPTION OF THE PREFERRED EMBODIMENTS

Embodiments of the present invention will now be described with reference to the accompanying drawings which form a part hereof.

First Embodiment

A connector in accordance with the first embodiment will be described with reference to FIGS. 1 through 6.

Figure 1:
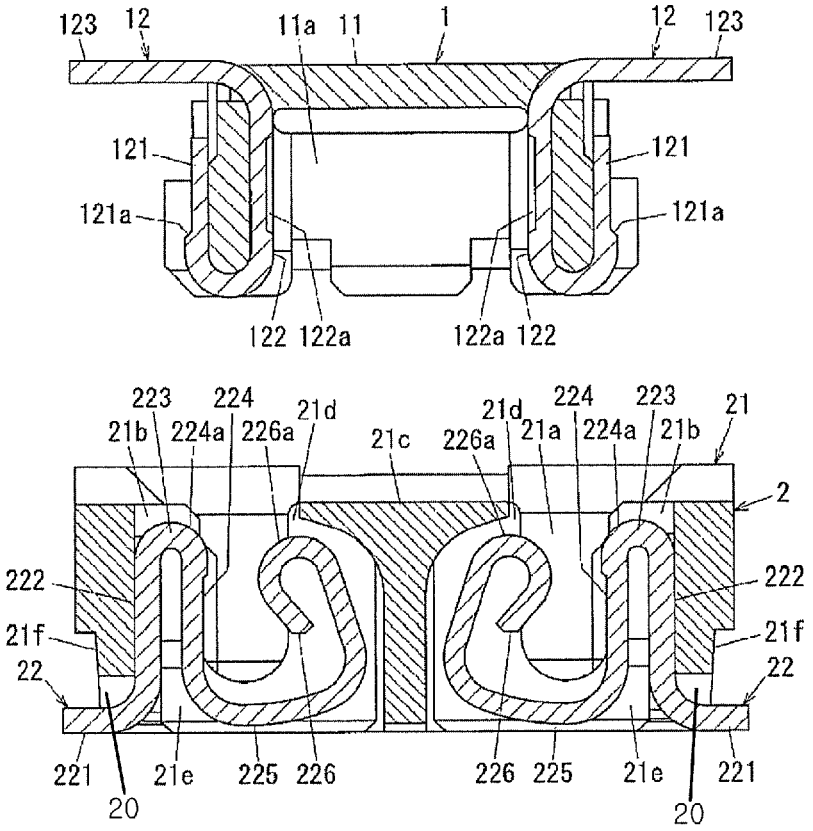
FIG. 1 is a section view showing a connector in accordance with a first embodiment of the present invention.

As shown in FIG. 1, the connector of the present embodiment includes a header 1 mounted to a first printed wiring board (not shown) and a socket 2 mounted to a second printed wiring board (not shown). The socket 2 includes a connection recess portion 21*a* into which the header 1 is removably inserted. If the header 1 is inserted into the connection recess portion 21*a* with the first and second printed wiring boards kept in an opposing relationship with each other, the first and second printed wiring boards are electrically connected to each other through the header 1 and the socket 2.

In the following description, the up-down direction and the left-right direction will be defined on the basis of FIG. 1. More specifically, the direction in which the header 1 is inserted into the connection recess portion 21*a* will be referred to as "downward direction". The direction in which the header 1 is removed from the connection recess portion 21*a* will be referred to as "upward direction". In other words, the term "up-down direction" used in the following description corresponds to the "insertion-removal direction" defined in the claims. The direction perpendicular to the paper surface in FIG. 1 will be referred to as "front-rear direction".

Figure 2:
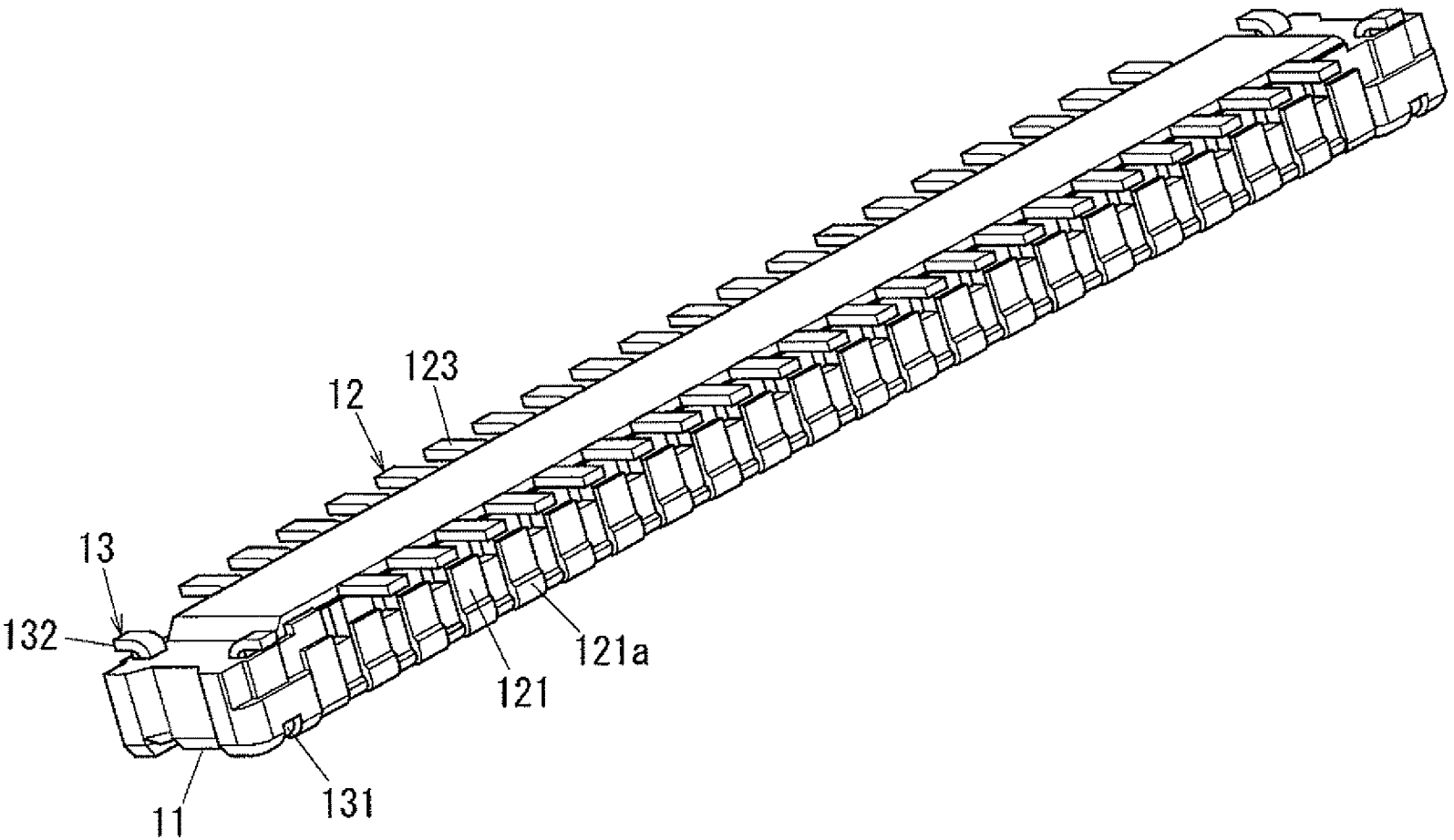
FIG. 2 is a perspective view showing a header employed in the first embodiment.

As shown in FIGS. 1 and 2, the header 1 includes a header body 11, header contact members 12 arranged and held in groups at the left and right sides of the header body 11 and ground contact members 13 electrically connected to the ground patterns of the first printed wiring board.

The header body 11 is made of an insulating material such as a synthetic resin and formed into a substantially rectangular columnar shape. An internal recess portion 11*a* extending in the front-rear direction is defined on the lower surface of the header body 11.

Each of the header contact members 12 includes a first contact portion 121 exposed in the left or right outer surface of the header body 11, a second contact portion 122 cooperating with the first contact portion 121 to form a U-shape to interpose the left or right wall of the internal recess portion 11*a* between the first and second contact portions 121 and 122, the second contact portion 122 exposed inwards in the internal recess portion 11*a*, and a mounting-purpose terminal portion 123 extending outwards from the upper end of the second contact portion 122 in the left or right direction, passing through the bottom surface of the internal recess portion 11*a* and protruding along the upper end surface of the header body 11 in the left or right direction. The respective header contact members 12 are held in the header body 11 by, e.g., insert-molding. By soldering the terminal portions 123 to the conductive patterns provided in the first printed wiring board, the header contact members 12 are electrically connected to the first printed wiring board.

Each of the ground contact members 13 includes a substantially U-shaped body-held portion 131 held within the header body 11 and a terminal portion 132 soldered to the ground pattern, the terminal portion 132 protruding from the upper end of the body-held portion 131 and extending along the upper end surface of the header body 11 in the left or right direction.

Figure 3:
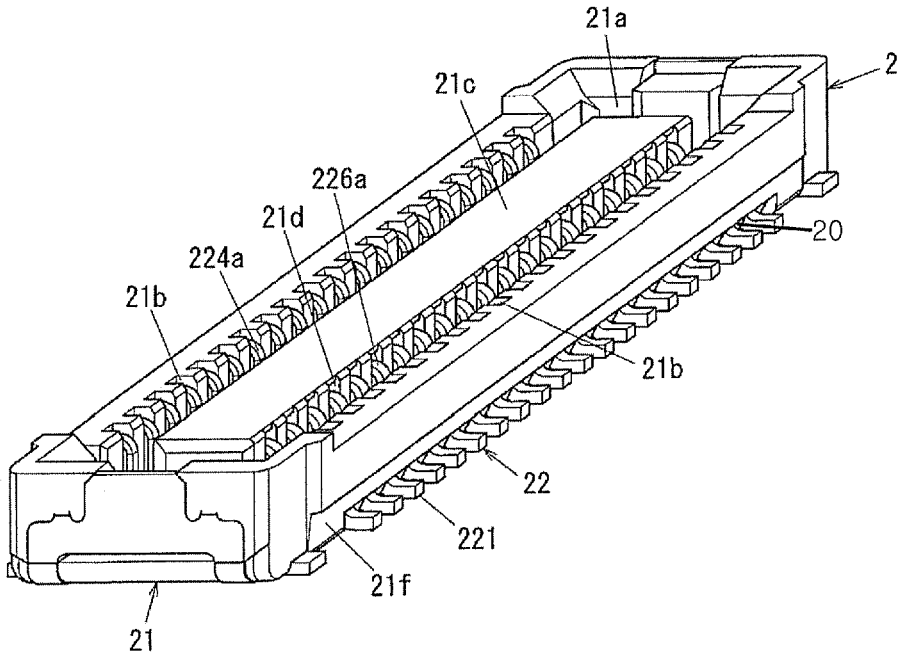
FIG. 3 is a perspective view showing a socket employed in the first embodiment.

As shown in FIGS. 1 and 3, the socket 2 includes a socket body 21 having a connection recess portion 21*a* formed on the upper surface thereof, socket contact members 22 held within the connection recess portion 21*a*, and lead-out pathways 20 formed in the left and right side walls to communicate with the connection recess portion 21*a*. One-end portions of the socket contact members 211 extend through the lead-out pathways 20 and protrude outwards beyond the outer surfaces of the left and right side walls of the socket body 21, respectively.

The socket body 21 is made of an insulating material such as a synthetic resin and formed into a substantially rectangular columnar shape. An internal raised portion 21*c* extending in the front-rear direction protrudes from the substantially central area of the connection recess portion 21*a*. On the left and right inner walls of the connection recess portion 21*a*, first contact member receiving grooves 21*b* for partially receiving the socket contact members 22 are formed side by side along the front-rear direction. On the left and right side surfaces of the internal raised portion 21*c*, second contact member receiving grooves 21*d* for partially receiving the socket contact members 22 are formed side by side along the front-rear direction.

On the bottom surface of the connection recess portion 21*a* of the socket body 21, guide grooves 21*e* communicating with the first contact member receiving grooves 21*b* and the second contact member receiving grooves 21*d* are formed in the positions corresponding to the respective socket contact members 22. The guide grooves 21*e* are formed to extend in the left-right direction from the left and right ends of the bottom surface of the socket body 21 toward the center of the bottom surface.

The lower end portions of the left and right side walls of the socket body 21 are continuously cut away along the front-rear direction to form depression portions 21*f* depressed more inwardly than the upper end portions of the left and right side walls. The depression portions 21*f* have a substantially rectangular cross section.

The socket contact members 22 are held in the socket body 21 so that, when the header 1 is inserted into the connection recess portion 21*a*, the socket contact members 22 can make conductive contact with the header contact members 12 in a one-to-one relationship.

In the present embodiment, the header contact members 12 and the socket contact members 22 are respectively formed by bending elongated metal plates having elasticity and conductivity. The header contact members 12 and the socket contact members 22 are arranged back and forth in two left and right rows and provided in plural sets, the width of the header contact members 12 and the socket contact members 22 extending in the same direction as the front-rear direction.

Figure 4A:
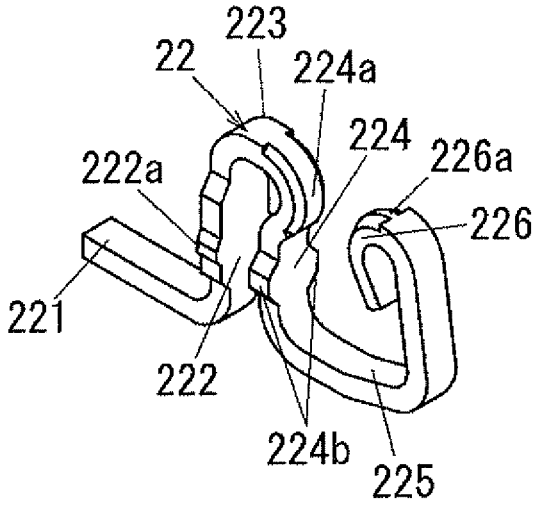
FIGS. 4A and 4B are perspective views showing socket contact members employed in the first embodiment.
Figure 4B:
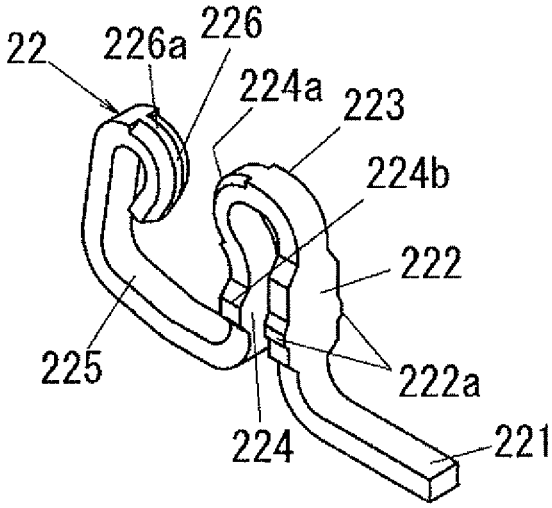

As shown in FIGS. 4A and 4B, each of the socket contact members 22 includes a mounting-purpose terminal portion 221 protruding more outwardly than the socket body 21 in the left-right direction, the thickness of the terminal portion 221 extending in the same direction as the up-down direction, a body-held portion 222 held in the socket body 21, the body-held portion 222 extending upwards from one left or right inner end of the terminal portion 221, a first connection portion 223 extending from the upper end of the body-held portion 222 to become distant from the terminal portion 221, a first contact portion 224 extending downwards from the tip end of the first connection portion 223 to make contact with the first contact portion 121 of each of the header contact members 12, a second connection portion 225 extending from the lower end of the first contact portion 224 to become distant from the body-held portion 222, and a second contact portion 226 extending upwards from the tip end of the second connection portion 225 to make elastic contact with the second contact portion 122 of each of the header contact members 12 in such a fashion that each of the header contact members 12 is interposed between the first contact portion 224 and the second contact portion 226. The left-right direction is defined as a terminal direction in the claims.

A raised engaged portion 224*a* of curved surface shape protruding away from the body-held portion 222 more distantly in the left-right direction than the remaining portions of the first contact portion 224 is provided in the upper end extension of the first contact portion 224. When the header 1 is completely engaged with the socket 2, only the raised engaged portion 224*a* of the first contact portion 224 makes contact with the corresponding one of the header contact members 12.

The second connection portion 225 is inclined upwards as it extends away from the first contact portion 224. Thus, the second connection portion 225 is elastically deformable so that the end portion thereof adjoining to the second contact portion 226 can be displaced downwards with respect to the end portion thereof adjoining to the first contact portion 224.

The tip end of the second contact portion 226 is bent toward the second connection portion 225 so that the second contact portion 226 can have a J-shape. This bending work creates a convex surface 226*a* making elastic contact with the corresponding one of the header contact members 12. Each of the socket contact members 22 is attached to the socket body 21 from below the socket body 21 by causing those portions from the body-held portion 222 to the second contact portion 226 to pass through each of the guide grooves 21*e*. At this time, the terminal portion 221 of each of the socket contact members 22 is received within the corresponding one of the guide grooves 21*e*. The tip end of the terminal portion 221 protrudes outwards from the lower end of the left or right wall of the socket body 21 through each of the guide grooves 21*e*. In other words, the socket contact members 22 protrude from the lower ends of the depression portions 21*f*.

The body-held portion 222 and the first connection portion 223 of each of the socket contact members 22 are received within each of the first contact member receiving grooves 21*b*. The raised engaged portion 224*a* elastically protrudes from each of the first contact member receiving grooves 21*b*. Moreover, the second contact portion 226 of each of the socket contact members 22 is received within each of the second contact member receiving grooves 21*d*. The upper end extension of the second contact portion 226 elastically protrudes from each of the second contact member receiving grooves 21*d*.

In this regard, press-fit bulge portions 222*a* and 224*b* are formed in the vertically middle extensions of the body-held portion 222 and the first contact portion 224 of each of the socket contact members 22 to protrude from the transverse opposite edges thereof in the transverse direction, i.e., in the front-rear direction. Each of the socket contact members 22 is held in the socket body 21 by press-fitting the press-fit bulge portions 222*a* and 224*b* between the inner surfaces of each of the first contact member receiving grooves 21*b* opposing in the front-rear direction. In this connection, the upper and lower end surfaces of the press-fit bulge portions 222*a* and 224*b* are inclined in the front-rear direction so that the protrusion dimension thereof is reduced toward the upper end lower ends. These inclined surfaces are guided by the inner surfaces of each of the first contact member receiving grooves 21*b*, whereby each of the socket contact members 22 can be moved into a specified position with ease.

A raised engaging portion 121*a*, which can override the raised engaged portion 224*a* of each of the socket contact members 22 when the header 1 is inserted into the connection recess portion 21*a*, is formed in the first contact portion 121 of each of the header contact members 12 to protrude outwards in the left-right direction. With this configuration, a worker can feel a clicking sense when the raised engaging portion 121*a* overrides the raised engaged portion 224*a*. The raised engaged portion 224*a* is positioned above the raised engaging portion 121*a* when the header 1 and the socket 2 are engaged with each other. Thus, a holding force is generated between the header 1 and the socket 2. An inclined surface with a protrusion dimension gradually increasing upwards is formed in the lower end portion of the raised engaging portion 121*a*. When the header 1 is inserted into the connection recess portion 21*a*, the raised engaged portion 224*a* is slid on the inclined surface, thereby reducing the force required in inserting the header 1. This makes it easy to connect the header 1 and the socket 2 together.

In the second contact portion 122 of each of the header contact members 12, a vertically elongated shelter recess portion 122*a* having a substantially V-like shape is formed on the surface of the second contact portion 122 opposing to the inner wall surface of the internal recess portion 11*a* of the header body 11. In this regard, the outer surface of the second contact portion 226 of each of the socket contact members 22 has a curved surface shape with the transverse middle portion thereof protruding more outwardly than the lateral end portions thereof. As a result, when the header 1 and the socket 2 are connected together, the second contact portion 226 of each of the socket contact members 22 makes elastic contact with the open edge of the shelter recess portion 122*a*. Therefore, even if a foreign material adheres to the second contact portion 122 or 226 of each of the header contact members 12 or the socket contact members 22, the foreign material is shoved into the shelter recess portion 122*a* by the second contact portion 226 as the header 1 is inserted into the connection recess portion 21*a*. This eliminates the possibility that the foreign material is caught between the header contact members 12 and the socket contact members 22. The reliability in, connection is enhanced by the shelter recess portion 122*a*.

Figure 5:
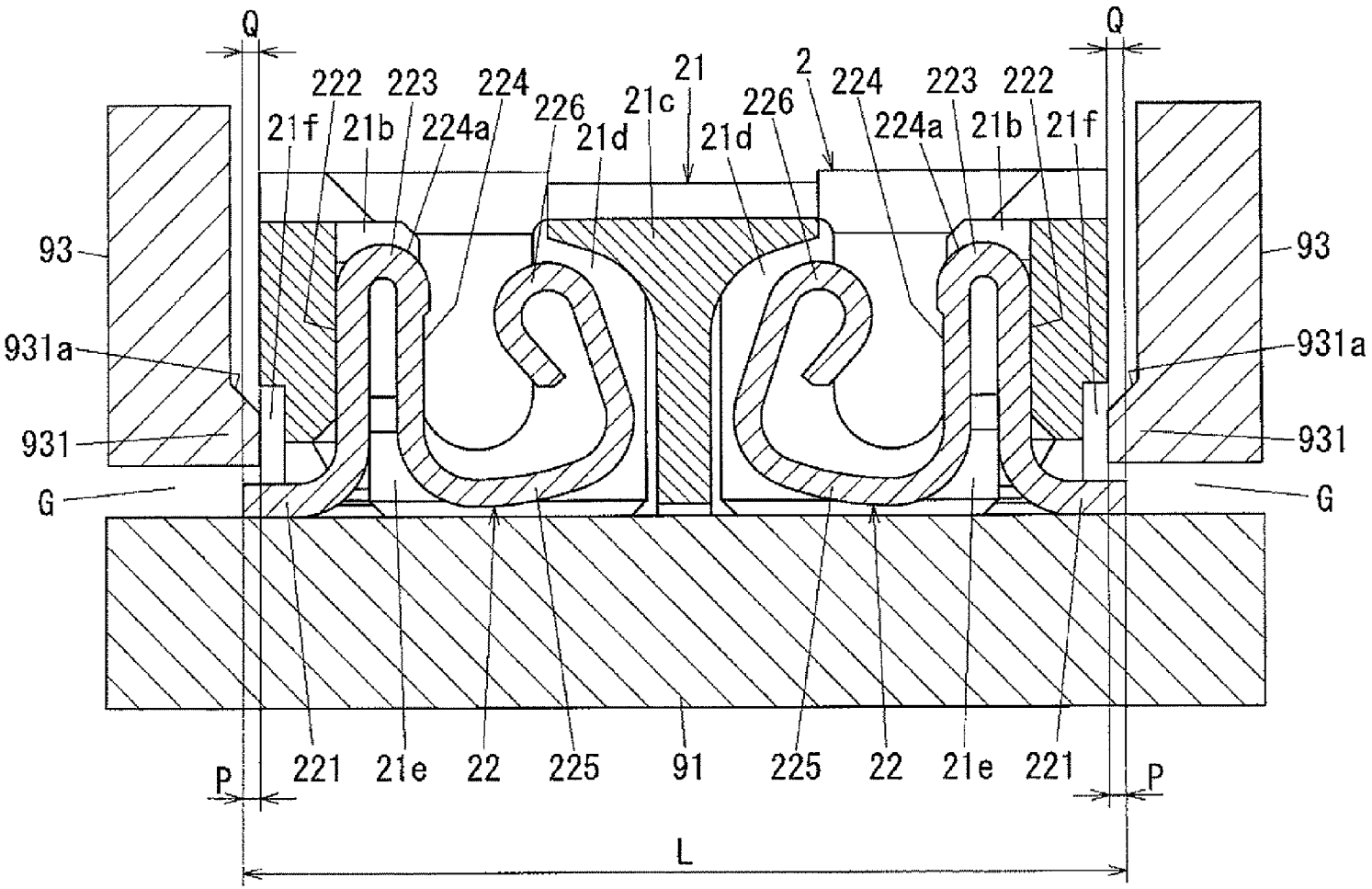
FIG. 5 is a section view illustrating the socket of the first embodiment under inspection.
Figure 10A:
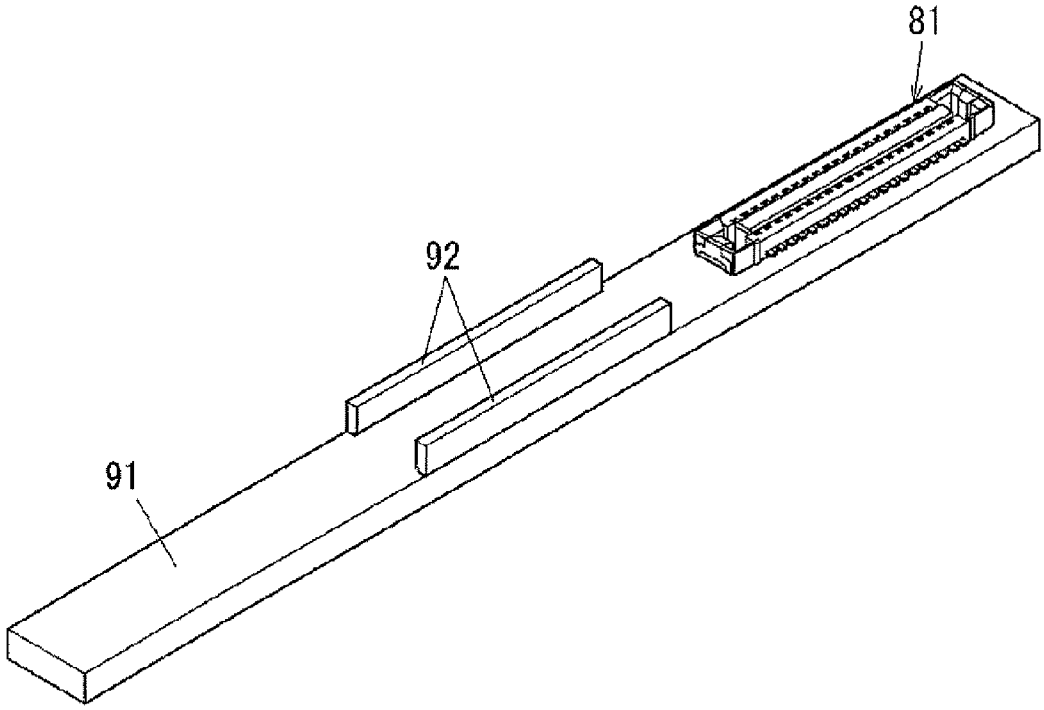
FIG. 10A (PRIOR ART)
FIGS. 10A, 10B and 10C are perspective views illustrating the socket of the second embodiment under inspection.
Figure 10B:
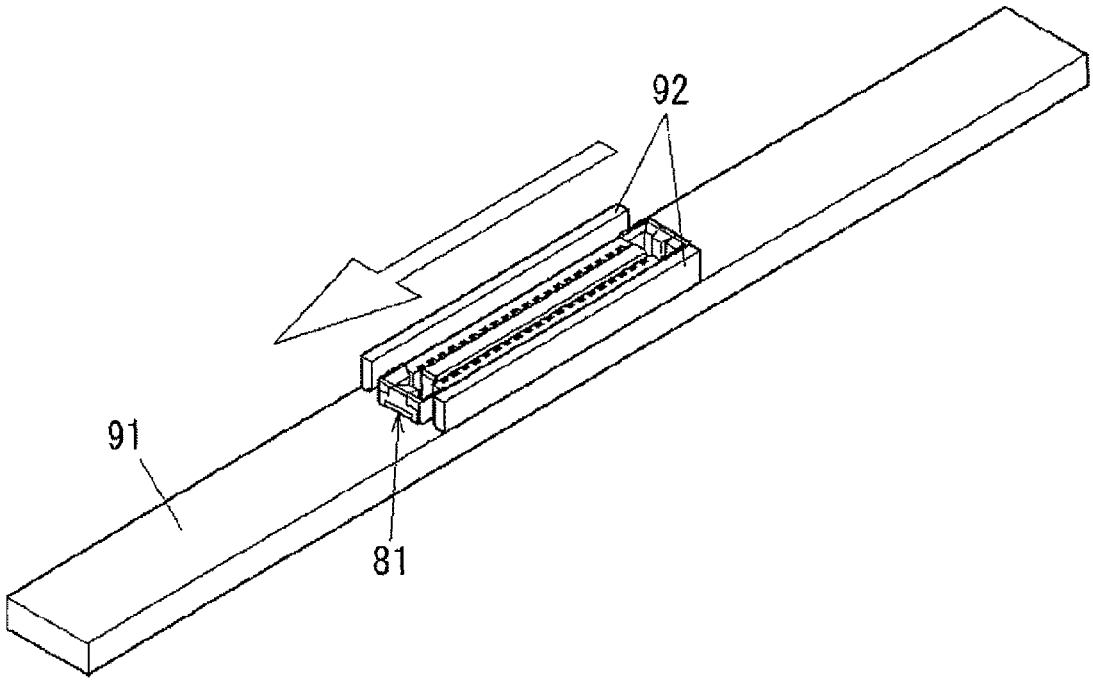
FIG. 10B (PRIOR ART)
Figure 10C:
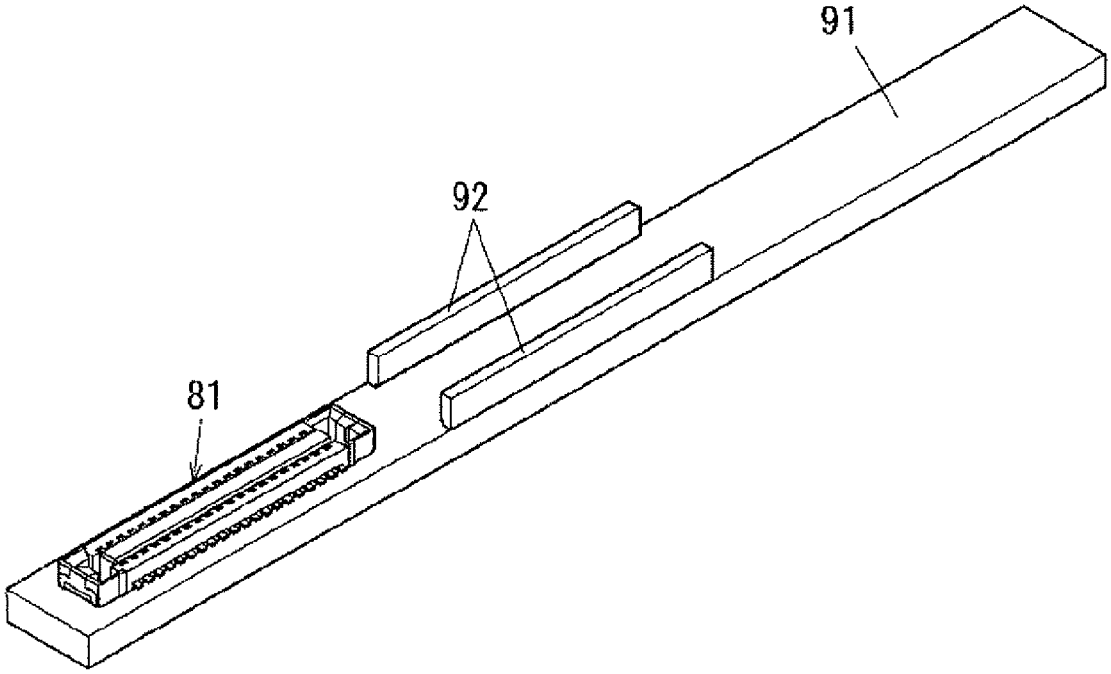
FIG. 10C (PRIOR ART)
Figure 11:
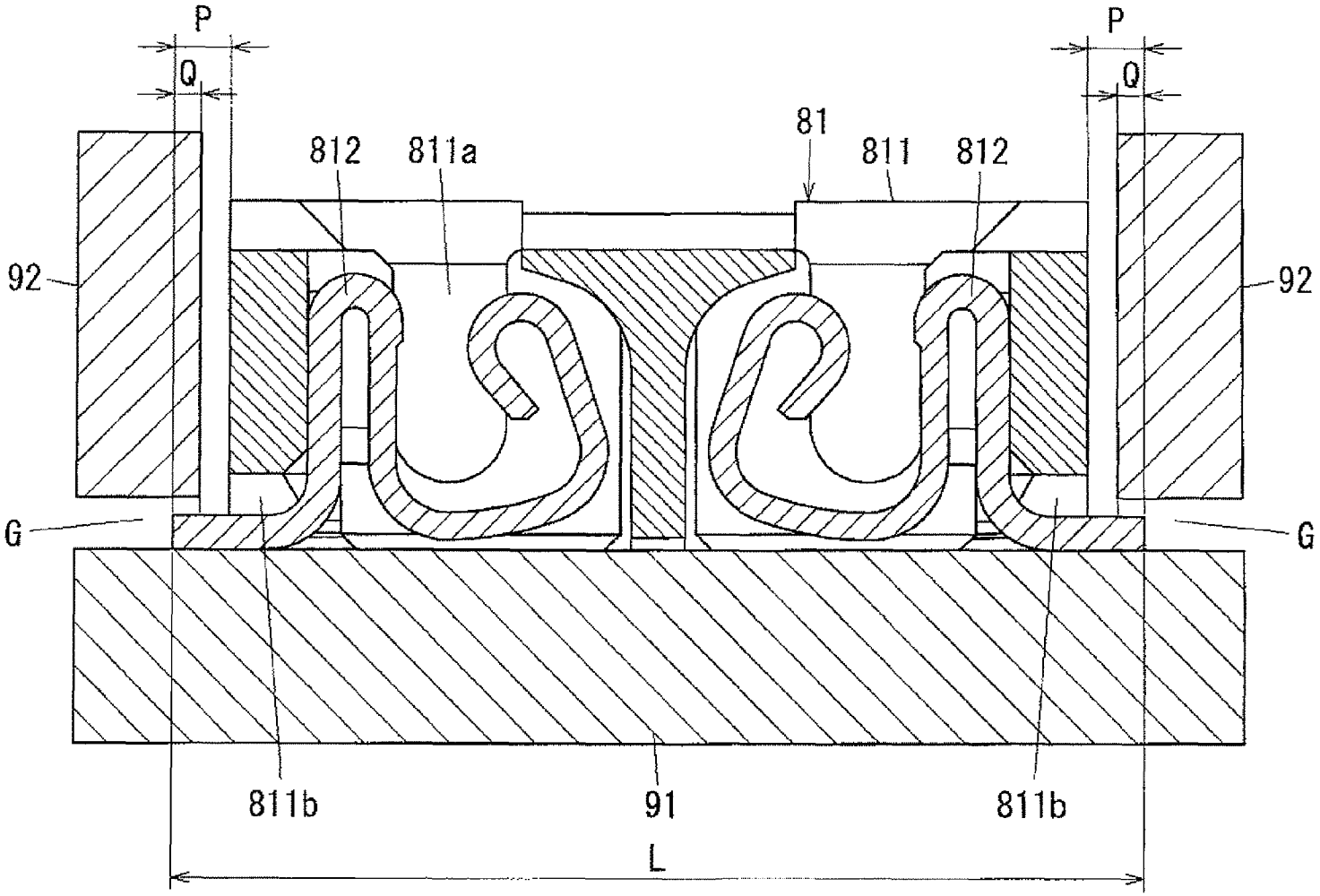
FIG. 11 (PRIOR ART)
FIG. 11 is a section view illustrating the socket of the second embodiment under inspection.
Figure 12:
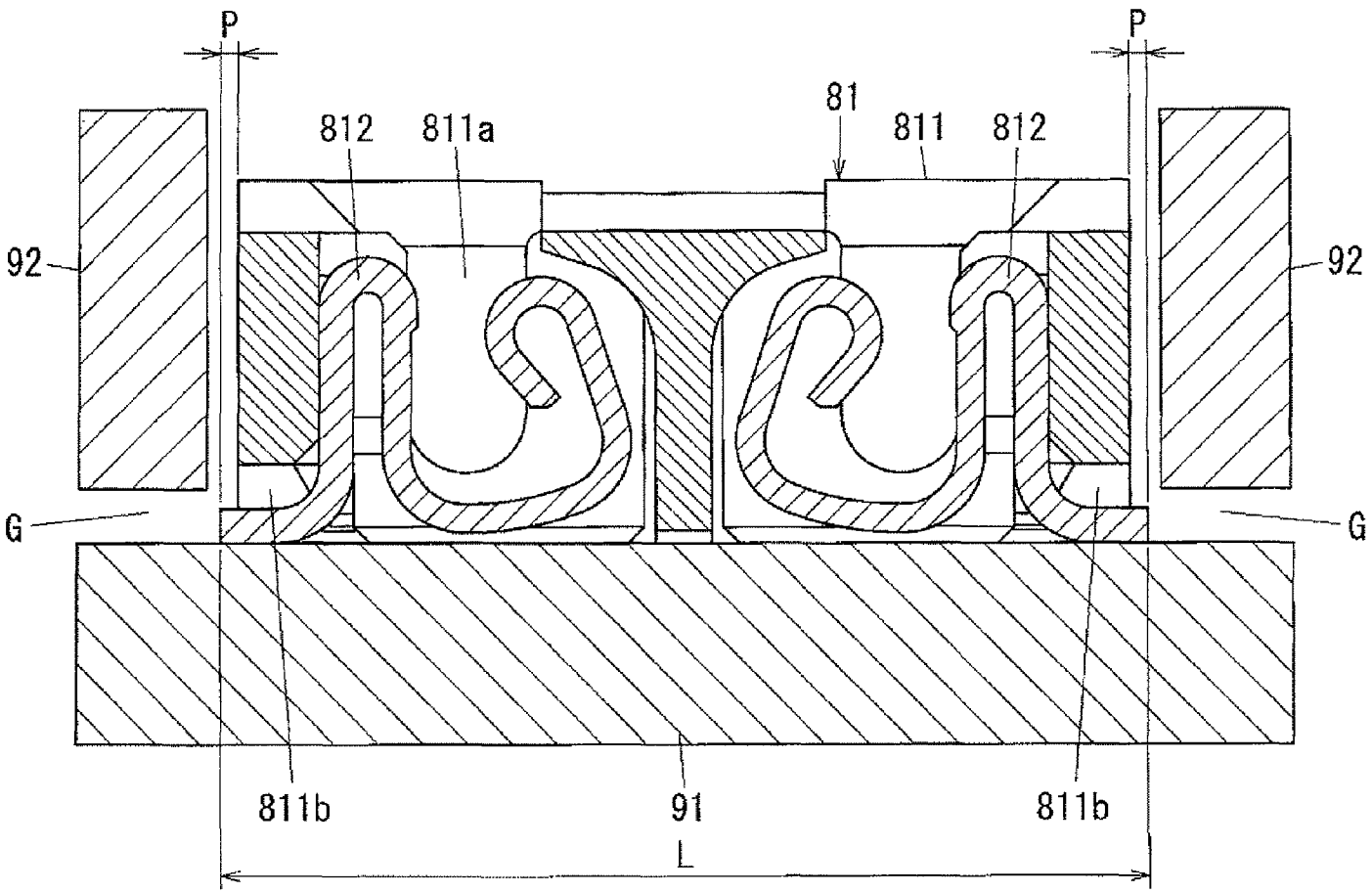
FIG. 12 (PRIOR ART)
FIG. 12 is a section view illustrating a socket with short socket contact members under inspection.

In this connection, the planarity inspection for the socket contact members 22 is performed in the same manner as in the prior art example. As shown in FIGS. 10 through 12, the socket 2 is conveyed on and along a rail 91 by an air blown toward the socket 2. Then, the socket 2 is moved between a pair of inspection jigs 93 so that the socket contact members 22 can pass through the gaps G between the rail 91 and the inspection jigs 93. Referring to FIG. 5, the inspection jigs 93 include insertion protrusions 931 formed in the lower end areas of the mutually opposing surfaces thereof. A slant surface 931*a* is formed in the upper end portion of each of the insertion protrusions 931, the slant surface 931*a* being inclined outwards as it goes upwards.

With the connector of the present embodiment configured as above, the depression portions 21*f* are formed in the lower end extensions of the left and right side walls of the socket body 21. The terminal portions 221 of the socket contact members 22 protrude outwards from below the depression portions 21*f*. Therefore, if the socket 2 is conveyed between the inspection jigs 93 during the planarity inspection as shown in FIG. 5, the insertion protrusions 931 of the inspection jigs 93 are inserted into the depression portions 21*f* of the socket body 21. Thus, the insertion protrusions 931 and the terminal portions 221 are overlapped with each other within the depression portions 21*f*. In other words, it becomes possible to obtain an overlapping amount Q of the terminal portions 221 of the socket contact members 22 and the insertion protrusions 931 of the inspection jigs 93 in the up-down direction, in the spaces between the bottom surfaces of the depression portions 21*f* and the tip ends of the socket contact members 22. Accordingly, even if the protrusion length P of the socket contact members 22 from the socket body 21 is reduced, it is possible to sufficiently increase the overlapping amount Q of the terminal portions 221 of the socket contact members 22 and the inspection jigs 93. This assists in reducing the width L of the socket 2. In a nutshell, the socket of the present embodiment is capable of enjoying reduction in size and allowing the planarity of the socket contact members 22 to be inspected with increased accuracy.

Since the depression portions 21*f* are continuously formed in the arrangement direction of the socket contact members 22 (namely, in the front-rear direction), the insertion protrusions 931 of the inspection jigs 93 can move through the depression portions 21*f* in the front-rear direction. Accordingly, the planarity inspection can be conducted with ease by merely inserting the insertion protrusions 931 of the inspection jigs 93 into the depression portions 21*f* and displacing the socket 2 in the front-rear direction. This makes it possible to shorten the inspection time and to reduce the number of inspection steps.

Figure 6:
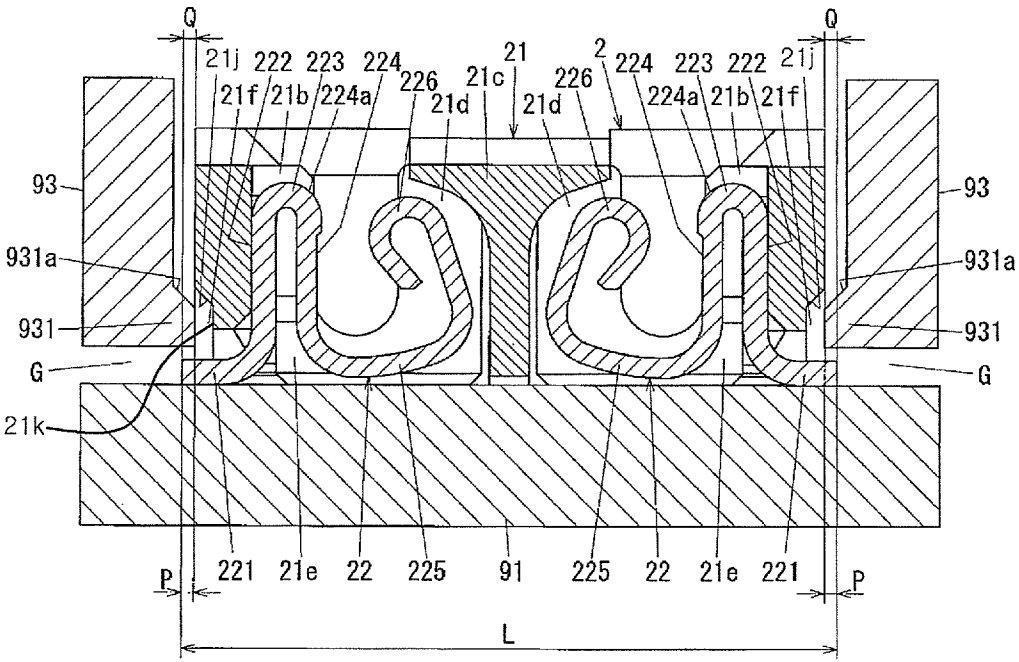
FIG. 6 is another section view illustrating the socket of the first embodiment under inspection.

Referring to FIG. 6, the upper end portion of each of the depression portions 21*f* may be a slant surface inclined upwards and outwards along the slant surface 931*a* of each of the insertion protrusions 931. In other words, the bottom surface 21*k* of each of the depression portions 21*f* makes an obtuse angle with respect to the upper inner surface 21*j* thereof. In this modification, the quantity of the material cut away from the socket body 21 to form the depression portions 21*f* can be reduced as compared with the socket body 21 shown in FIG. 5. It is also possible to increase the strength of the socket body 21.

Second Embodiment

A socket in accordance with the second embodiment of the present invention will be described with reference to FIG. 7. In the following description, the up-down direction and the left-right direction will be defined on the basis of FIG. 7. The direction perpendicular to the up-down direction and the left-right direction will be referred to as "front-rear direction".

The connector of the present embodiment differs from the connector of the first embodiment in that the socket body 21 includes a plurality of depression portions 21*g* independently formed on the left and right side walls thereof in a one-to-one relationship with the socket contact members 22. Other configurations remain the same as those of the first embodiment. The same components will be designated by like reference numerals and will be omitted from description.

Figure 7:
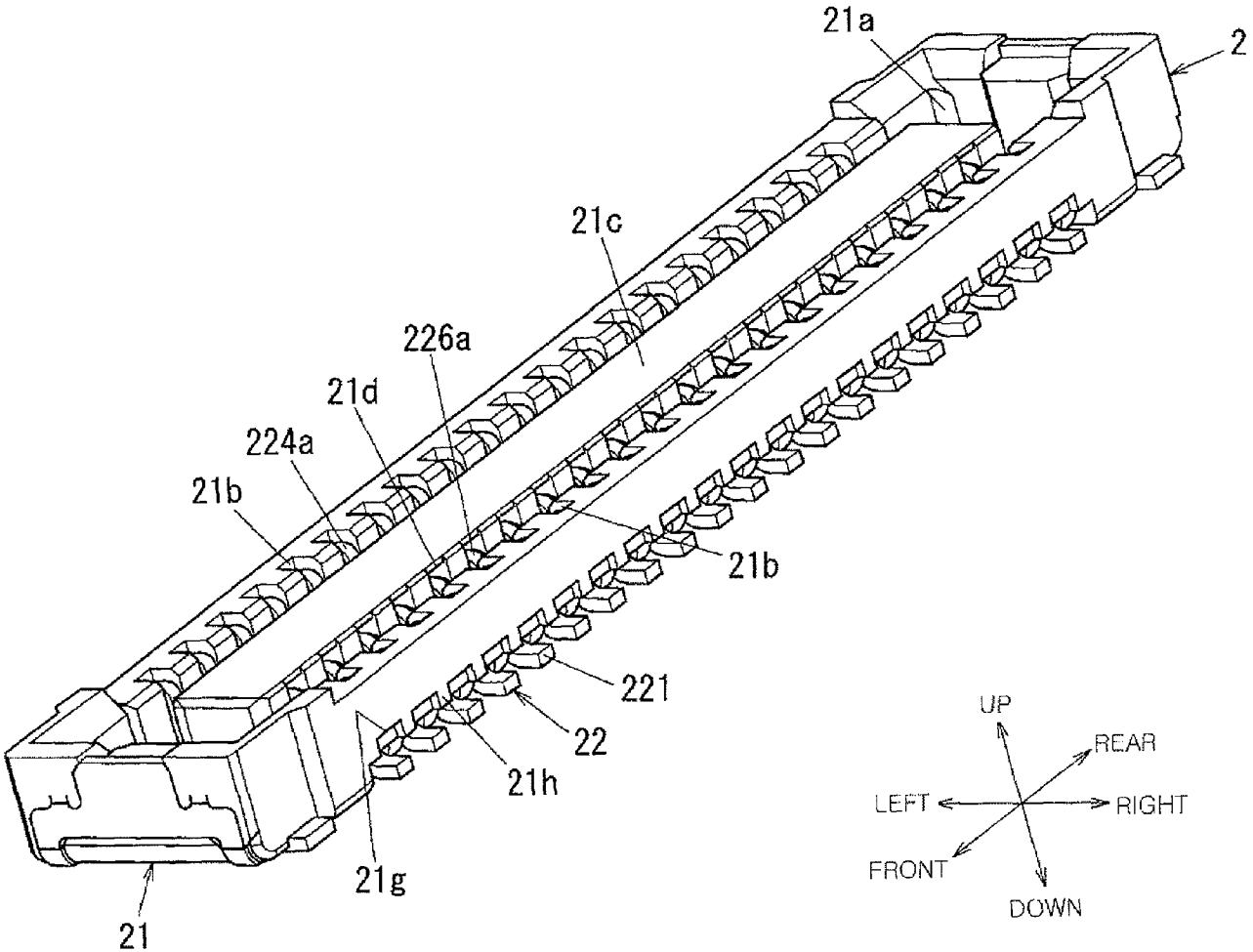
FIG. 7 is a perspective view showing a socket in accordance with a second embodiment of the present invention.

In the present embodiment, as shown in FIG. 7, depression portions 21*g* are formed in the lower end areas of the left and right side walls of the socket body 21 and are arranged at a substantially equal interval along the front-rear direction with partition walls 21*h* left between the depression portions 21*g*. In this regard, the lower ends of the depression portions 21*g* are in communication with the guide grooves 21*e*. The socket contact members 22 protrude from below the respective depression portions 21*g*.

Figure 8A:
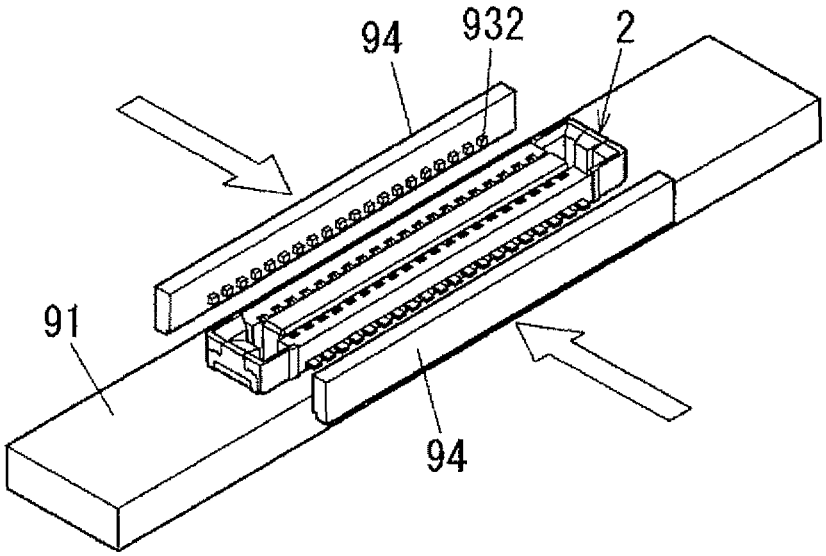
FIGS. 8A through 8C are perspective views illustrating the socket of the second embodiment under inspection.

When the planarity inspection is conducted with respect to the socket 2 configured as above, the socket 2 placed on a rail 91 is conveyed along the rail 91 by an air and is stopped between a pair of inspection jigs 94 as illustrated in FIG. 8. In this regard, the inspection jigs 94 are kept spaced apart from the rail 91 in the direction perpendicular to the conveying direction of the rail 91 until the socket 2 is conveyed to between the inspection jigs 94. If the socket 2 arrives between the inspection jigs 94 as illustrated in FIG. 8A, the inspection jigs 94 are moved toward the socket 2.

Figure 8B:
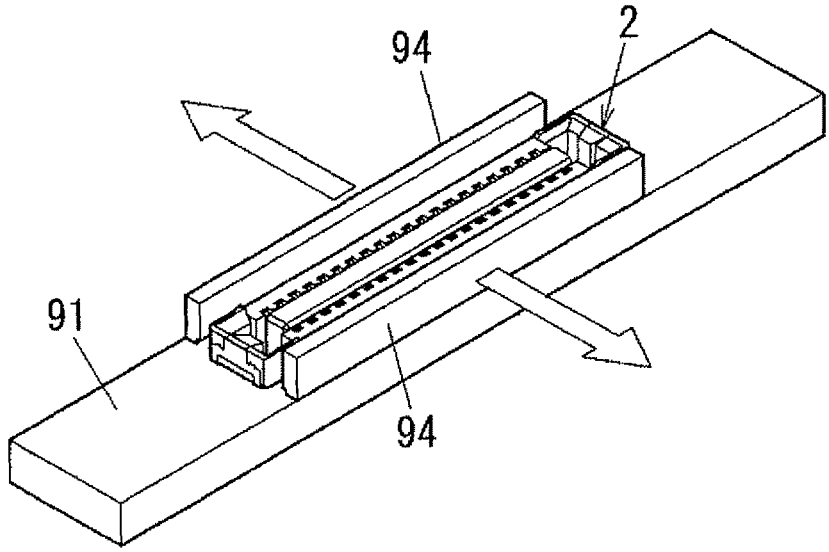
Figure 8C:
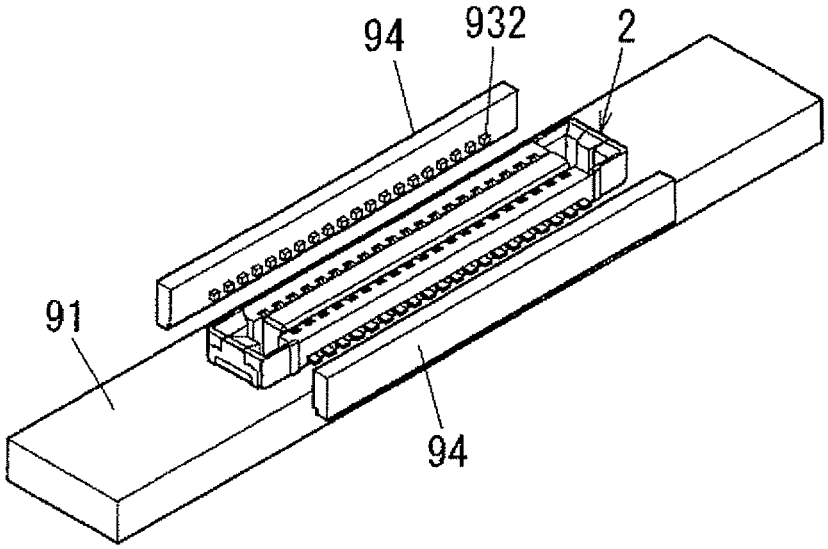
Figure 9:
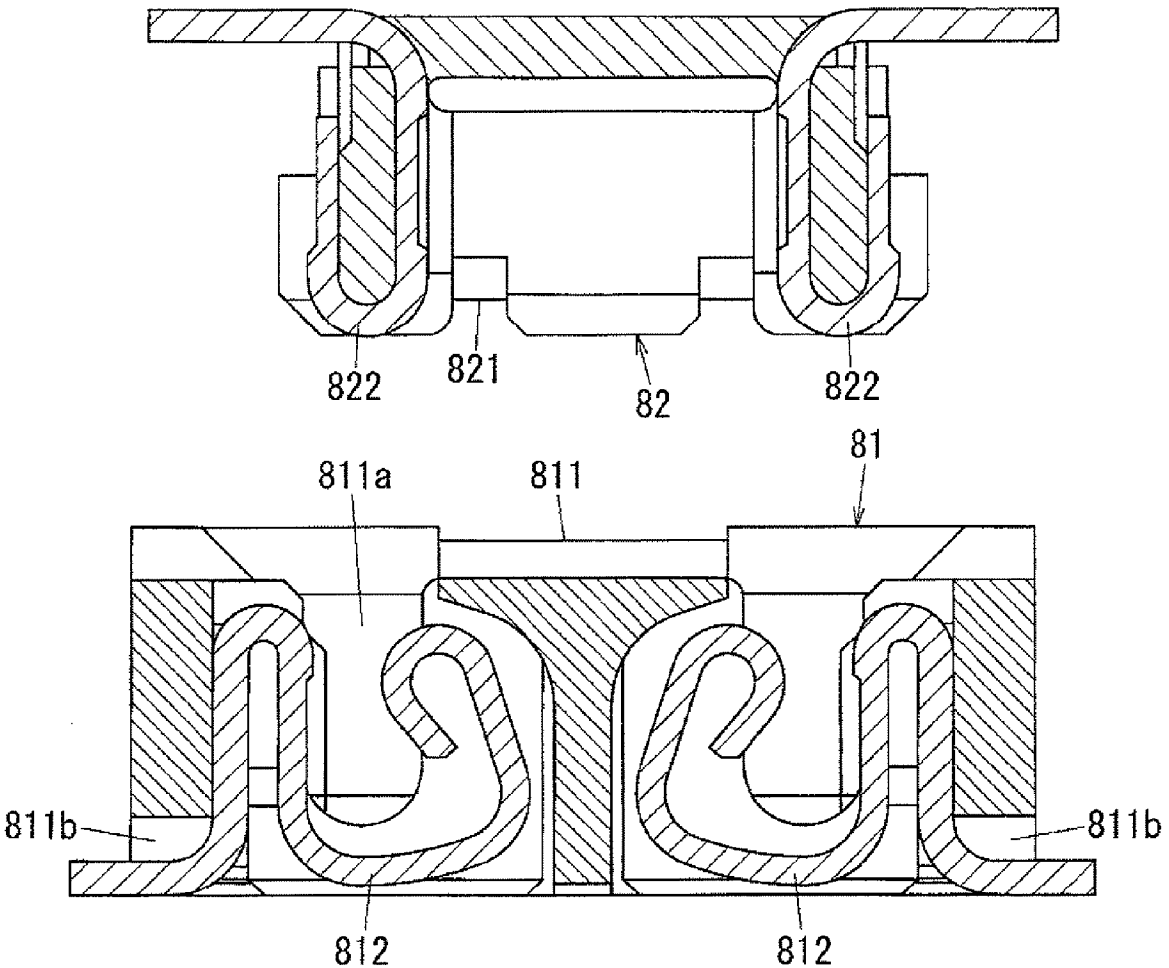
FIG. 9 (PRIOR ART)
FIG. 9 is a section view showing a conventional connector.

The inspection jigs 94 include insertion protrusions 932 formed in the lower end areas of the mutually opposing surfaces thereof and arranged side by side along the conveying direction of the rail 91. The interval of the insertion protrusions 932 is equal to the interval of the socket contact members 22. Therefore, if the inspection jigs 94 are moved toward the socket 2, the insertion protrusions 932 are inserted into the respective depression portions 21*g* as illustrated in FIG. 8B. The socket 2 is determined to have a good quality if the inspection jigs 94 do not make contact with the socket contact members 22. Otherwise, the socket 2 is determined to have a poor quality. If the inspection comes to an end, the inspection jigs 94 are moved away from the socket 2 as illustrated in FIG. 8C. Thereafter, the socket 2 is conveyed along the rail 91.

With the socket of the present embodiment configured as above, the depression portions 21*g* are formed only in the minimum areas of the socket body 21 required in conducting the planarity inspection of the socket contact members 22. Accordingly, the socket of the present embodiment is capable of allowing the planarity inspection to be conducted with increased accuracy and reducing the quantity of the material cut away from the socket body 21, in proportion to the quantity of the partition walls 21*h* remaining in the socket body 21. Consequently, it is possible to increase the strength of the socket body 21.

While the invention has been shown and described with respect to the embodiments, it will be understood by those skilled in the art that various changes and modification may be made without departing from the scope of the invention as defined in the following claims.

What is claimed is:

1. A socket, comprising:

a substantially rectangular columnar socket body made of an insulating material, the socket body including a connection recess portion defined on one surface thereof, side walls opposed to each other in a transverse direction and a lead-out pathway formed at a lower portion of each of at least one of the side walls; and a plurality of socket contact members arranged side by side within the connection recess portion along a longitudinal direction, one-end portions of the socket contact members extending through the lead-out pathway and protruding outwards beyond an outer surface of each of said at least one of the side walls of the socket body, wherein the socket body includes a depression portion formed at the lower portion of each of said at least one of the side walls in a region surrounding and above the lead-out pathway, wherein the depression portion is configured to allow an inspection jig to be inserted into the depression portion to inspect planarity of the one-end portions of the socket contact members.

2. A connector, comprising:

the socket of claim 1; and a header including a header body made of an insulating material and a plurality of header contact members held in the header body, the header contact members arranged to make conductive contact with the socket contact members when the header is inserted into the connection recess portion of the socket.

3. The socket of claim 1, wherein the depression portion is formed to continuously extend from one longitudinal end of the socket body to the other longitudinal end.

4. The socket of claim 3, wherein the depression portion includes an inner wall surface being inclined to make an obtuse angle with respect to a bottom surface thereof.

5. A connector, comprising:

the socket of claim 4; and a header including a header body made of an insulating material and a plurality of header contact members held in the header body, the header contact members arranged to make conductive contact with the socket contact members when the header is inserted into the connection recess portion of the socket.

6. A connector, comprising:

the socket of claim 3; and a header including a header body made of an insulating material and a plurality of header contact members held in the header body, the header contact members arranged to make conductive contact with the socket contact members when the header is inserted into the connection recess portion of the socket.

7. The socket of claim 1, wherein the depression portion is provided in plural number at the lower portion of each of said at least one of the side walls in a one-to-one relationship with the socket contact members.

8. The socket of claim 7, wherein each of the depression portions includes an inner wall surface being inclined to make an obtuse angle with respect to a bottom surface thereof.

9. A connector, comprising:

the socket of claim 8; and a header including a header body made of an insulating material and a plurality of header contact members held in the header body, the header contact members arranged to make conductive contact with the socket contact members when the header is inserted into the connection recess portion of the socket.

10. A connector, comprising:

the socket of claim 7; and a header including a header body made of an insulating material and a plurality of header contact members held in the header body, the header contact members arranged to make conductive contact with the socket contact members when the header is inserted into the connection recess portion of the socket.

11. The socket of claim 1, wherein the depression portion includes an inner wall surface being inclined to make an obtuse angle with respect to a bottom surface thereof.

12. A connector, comprising:

the socket of claim 11; and a header including a header body made of an insulating material and a plurality of header contact members held in the header body, the header contact members arranged to make conductive contact with the socket contact members when the header is inserted into the connection recess portion of the socket.

13. A socket, comprising:

a substantially rectangular columnar socket body made of an insulating material, the socket body including a connection recess portion defined on an upper surface thereof, side walls opposed to each other in a transverse direction and a lead-out pathway formed at a lower portion of each of at least one of the side walls; and a plurality of socket contact members arranged side by side within the connection recess portion along a longitudinal direction, one-end portions of the socket contact members extending through the lead-out pathway and protruding outwards beyond an outer surface of each of said at least one of the side walls of the socket body, wherein the socket body includes a depression portion formed at a lower portion of the outer surface of each of said at least one of the side walls and at least a part of the depression portion is formed directly above the lead-out pathway, wherein the depression portion is configured to allow an inspection jig to be inserted into the depression portion to inspect planarity of the one-end portions of the socket contact members.

14. The socket of claim 13, wherein the depression portion includes an inner wall surface being inclined to make an obtuse angle with respect to a bottom surface thereof.

15. A connector, comprising:

the socket of claim 13; and a header including a header body made of an insulating material and a plurality of header contact members held in the header body, the header contact members arranged to make conductive contact with the socket contact members when the header is inserted into the connection recess portion of the socket.

16. The socket of claim 13, wherein the depression portion is formed to continuously extend from one longitudinal end of the socket body to the other longitudinal end.

17. The socket of claim 16, wherein the depression portion includes an inner wall surface being inclined to make an obtuse angle with respect to a bottom surface thereof.

18. The socket of claim 13, wherein the depression portion is provided in plural number at the lower portion of each of said at least one of the side walls in a one-to-one relationship with the socket contact members.

19. The socket of claim 18, wherein each of the depression portions includes an inner wall surface being inclined to make an obtuse angle with respect to a bottom surface thereof.

* * * * *